United States Patent [19]

Tsutsui et al.

[11] 4,113,580

[45] Sep. 12, 1978

[54] STEEL SHEET USEFUL IN FORMING FOODSTUFF AND BEVERAGE CANS

[75] Inventors: Nobuyuki Tsutsui, Kudamatsu; Tsuneo Inui, Tokuyama; Hiroaki Kawamura, Kudamatsu, all of Japan

[73] Assignee: Toyo Kohan Co., Ltd., Tokyo, Japan

[21] Appl. No.: 818,099

[22] Filed: Jul. 21, 1977

[30] Foreign Application Priority Data

Aug. 18, 1976 [JP] Japan ..... 51-97739

[51] Int. Cl.$^2$ ..... C25D 5/50; C25D 5/10

[52] U.S. Cl. ..... 204/37 T; 204/40

[58] Field of Search ..... 204/37 T

[56] References Cited

U.S. PATENT DOCUMENTS

| | | | |
|---|---|---|---|
| 2,974,091 | 3/1961 | Neish | 204/37 T |
| 3,890,164 | 6/1975 | Harada et al. | 204/37 T |

FOREIGN PATENT DOCUMENTS

| | | |
|---|---|---|
| 4,745,253 | 11/1972 | Japan. |
| 4,818,929 | 6/1973 | Japan. |
| 4,937,829 | 4/1974 | Japan. |

*Primary Examiner*—John H. Mack
*Assistant Examiner*—William T. Leader
*Attorney, Agent, or Firm*—Wenderoth, Lind & Ponack

[57] ABSTRACT

A steel sheet which has been treated to form thereon a first layer of an iron-tin alloy and a second layer of hydrated chromium oxide. This treated steel sheet can be effectively coated with an organic coating, and is useful in forming cans for foodstuffs and carbonated beverages.

11 Claims, 2 Drawing Figures

STEEL SHEET USEFUL IN FORMING FOODSTUFF AND BEVERAGE CANS

FIELD OF THE INVENTION

The present invention relates to a steel sheet having an extremely thin duplex layer thereon, the upper layer (layer further from the steel base) of which consists of hydrated chromium oxide and the lower layer (layer closer to the steel base) of which consists mainly of an iron-tin alloy ($FeSn_2$), which lower layer is formed by heating a steel sheet having a very thin tin plating thereon. The steel sheet having such duplex layer can be coated with an organic coating.

DESCRIPTION OF THE PRIOR ART

Electrotinplate has been used for manufacturing food cans, but for some years now tin free steel (TFS) consisting of metallic chromium and hydrated chromium oxide has been largely used for manufacturing carbonated beverage cans, instead of electrotinplate.

The ordinary metal can consists of two pieces of the can ends and one piece of the can body. The seaming of the tinplate can body is only limited in the case of soldering. In the soldering process of the tinplate can body, problems occur, such as surface discoloration. Another problem is caused by flux generated by metallic tin on the tinplate when heated above 232° C., which is the melting point of metallic tin. This flux causes corrosion of the surface tin.

Recently methods of seaming the tinplate can body by organic adhesive have been proposed. One of these methods relates to a tinplate in which tin and an iron-tin alloy coexist on the surface of the tinplate. (Laid-Open Japanese Patent Application No. Sho 49-37829). Another relates to a tinplate having chromium oxide containing from 3 to 20 $\mu g/dm^2$ as chromium, and tin oxide in an amount corresponding to 160–640 millicoulomb/$dm^2$ in terms of the quantity of electricity required for reduction of the tin oxide (Japanese Patent Publication No. Sho 48-18929).

However after a few months, these tinplate can bodies, seamed by an organic adhesive, may be broken, because the peel strength in the seam is remarkably low.

The exchange to cheaper TFS from expensive electrotinplate, and the decrease of tin coating weight in electrotinplate, have been examined in the field of food cans, because tin used for the production of tinplate is very expensive, and there is concern over the exhaustion of tin resources in the world.

Organic adhesives are generally used for seaming can bodies made with TFS. In the case of TFS used for food cans, there are some problems such as formation of rust under the organic film, dissolution of iron by local corrosion in cracks in the organic coating, and deterioration of the flavor of foodstuffs by iron pick-up, during long storage, in the formed parts of TFS cans, particularly the flange in the can body and the chuck wall radius in the can ends. Therefore, TFS is not satisfactory as a material for food cans.

Cracks are formed in TFS films because the formability of such films is poor. In turn, these cracks may lead to formation of cracks in paint film coated on the TFS films.

While the metallic chromium layer in TFS film acts as a cathode, the base steel acts as an anode because the potential of metallic chromium is more noble than the potential of base steel in a foodstuff. Therefore, if the formed part of TFS contacts with a foodstuff, a local cell is formed between the metallic chromium and the base steel, resulting in acceleration of corrosion of the base steel. Furthermore, the corrosion reaction is concentrated in the formed part of the TFS film, where the steel base is exposed through cracks in the film, although the undercutting corrosion observed in black plate and tinplate does not occur in TFS because of the insolubility of metallic chromium in foodstuffs.

In TFS cans containing carbonated beverages of lower pH, the local corrosion of the steel base proceeds to the point where perforations may occur in the steel base. With foodstuffs of comparatively higher pH, such as vegetable soup, fish and meat, rust occurs in the formed part of the cans, where the steel base is exposed.

In order to produce tinplate and TFS having excellent corrosion resistance as containers for acidic foodstuffs, particularly carbonated beverages, the addition of various elements to steel during steel production has been proposed (Japanese Patent Publication Nos. Sho 46-39577, Sho 48-3049, Sho 48-3050 and Sho 48-3051). This metnod is undesirable because of problems such as formation of scratches on the steel surface after the steel has been produced, and deterioration in the flavor of foodstuffs caused by dissolution of the elements added to the steel.

SUMMARY OF THE INVENTION

It is an object of the present invention to provide a steel sheet which has been treated to enable it to undergo organic coating, and which has excellent paint adhesion and bonding strength with organic adhesives, as well as high corrosion resistance, after forming into cans, against foodstuffs such as acidic drinks, vegetables, fish and meats.

The steel sheet, after being treated according to the present invention, has a thin duplex layer, the upper layer of which is substantially uniform in thickness and consists essentially of hydrated chromium oxide containing from 0.005 to 0.05 $g/m^2$ as chromium, and the lower layer of which is substantially uniform in thickness and consists mainly of iron-tin alloy ($FeSn_2$) having from 0.05 to 1.0 $g/m^2$ as tin.

Throughout the specification and claims the designation "$g/m^2$" represents grams per square meter of the surface area of the top or bottom surface of the steel sheet base.

According to the present invention, it is possible to avoid the various problems associated with electrotinplate and TFS used for food cans, as described above.

In the steel sheet treated according to the present invention, the formation of cracks in the organic film coated on the treated steel sheet does not occur to the extent exhibited by TFS cans, because the formability of the very thin iron-tin alloy layer, which is underneath the layer of hydrated chromium oxide, is better than that of the metallic chromium layer in TFS. Furthermore, although both iron-tin alloy and metallic chromium show noble potential against the steel base, and the iron-tin alloy is slightly soluble in carbonated beverages, the potential difference between the iron-tin alloy and the steel base is smaller than that between metallic chromium and the steel base. Therefore local corrosion of the steel base in the formed part occurs only with difficulty and surface corrosion is only slightly observed, in the steel sheet treated according to the present invention, as compared with TFS.

BRIEF DESCRIPTION OF THE DRAWINGS

FIG. 1 shows the state in which the lower layer 6 composed mainly of an iron-tin alloy ($FeSn_2$), and an upper layer 8 consisting essentially of hydrated chromium oxide, are formed on the steel base 5, and an oil film 9 is coated on the surface of the resultant steel sheet.

FIG. 2 shows the state in which a metallic chromium layer 7, the original amount of which is desirably zero, is deposited reluctantly between the hydrated chromium oxide layer 8 and the iron-tin alloy layer 6.

DETAILED DESCRIPTION OF THE INVENTION

Figure 1:
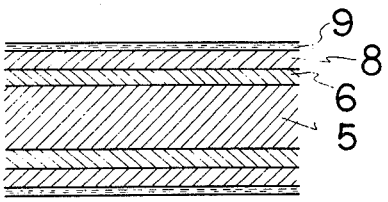
FIGS. 1 and 2 show magnified schematic diagrams in section of the steel sheet treated in accordance with the present invention.
Figure 2:
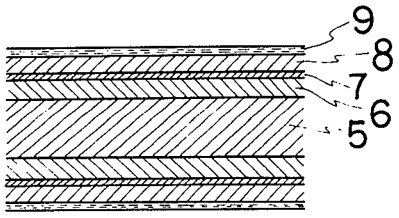

It is possible to produce the steel sheet according to the present invention very easily, without reconstructing commercial electrotinning lines.

In the case of constructing a new installation for the production of the steel sheet according to the present invention, the construction cost is relatively inexpensive because it is not necessary to use a large number of plating tanks. Furthermore, it is possible to continuously produce, on a large scale, the steel sheet at higher speed and with less cost, since only a relatively small amount of tin is necessary.

The steel sheet treated according to the present invention, which has excellent characteristics of paint adhesion, bonding adhesion by organic adhesives, and corrosion resistance after forming, can be used to manufacture cans for carbonated beverages, currently being formed from tinplate and TFS on a large scale, as well as fruit juice cans, currently being formed by using organic coated tinplate. Two-piece cans, such as oval cans, as well as drawn and redrawn cans, can also be manufactured by using the treated steel sheet of the present invention.

The steel sheet treated according to the present invention is produced by a process which comprises, as the only essential steps, electrolytically tin plating a substantially clean steel sheet, heating the tin-plated steel sheet to form an iron-tin alloy on the steel sheet surface, and subjecting the resultant steel sheet to electrolytic chromic acid treatment to form a layer of hydrated chromium oxide on the exposed surface of the iron-tin alloy.

From an industrial point of view, the present invention can be carried out according to the following process: degreasing with an alkali and pickling with an acid → water-rinsing → very thin electrolytic tin plating → water-rinsing → drying → formation of an iron-tin alloy by heating → quenching → electrolytic chromic acid treatment → water-rinsing → drying → oiling, for example with dioctyl sebacate or cottonseed oil.

The steel sheet base preferably has a thickness of about 0.1–0.35 mm.

For the electrolytic tinning in the present invention, the known tinplating electrolyte is used, namely an acidic electrolyte such as stannous sulfate, stannous chloride and stannous fluoborate, or an alkaline electrolyte such as sodium stannate and potassium stannate.

Particularly, according to the electrolytic tinplating using the known alkaline electrolyte or the weakly acidic electrolyte having a low concentration of stannous ions, as described in Japanese Patent Publication No. Sho 46-25603, in which hydrogen gas is generated in a considerable amount during electrotinplating, the dense tin layer obtained, with attendant formation of only a small amount of dense iron-tin alloy ($FeSn_2$), shows better corrosion resistance, paint adhesion and bonding properties by organic adhesives, because the uniform iron-tin alloy layer is formed on the entire surface by the heat treatment. Therefore, in the present invention the formation of a dense tin layer is most important.

The solid diffusion method, which is a known method of forming an iron-tin alloy layer by heating at a temperature below the melting point of tin, is permissible, but is not industrially feasible because of the necessity for a lengthy heat treatment.

The known method in which a temperature above the melting point of tin is maintained for a short time by resistance heating, induction heating using a magnetic field, or heating by combustion gas in a non-oxidizing atmosphere, can be used for the formation of the iron-tin alloy. The formation of the iron-tin alloy by immersion of the tin-plated steel sheet into heated palm oil is permissible, but is not suitable for high speed production, in view of the necessity for a post-treatment to remove the palm oil from the surface of the alloy.

The conditions of the electrolytic tin plating are preferably as follows:

In an acidic electrolyte:
Concentration of stannous ions: 1.5–20 g/l
Concentration of acid (as $H_2SO_4$): 1.0–15 g/l
Weight ratio of stannous ions to acid: 1–3
Bath temperature: 30°–60° C.
Current density: 5–50 A/dm$^2$ Generally, lower current density is applied for the formation of a dense tin layer at lower bath temperature, lower concentration of stannous ions and higher concentration of acid. On the contrary, at higher bath temperature, higher concentration of stannous ions and lower concentration of acid, a higher current density is applied. Furthermore, in the case of a concentration of stannous ions and acid below 1.5 and 1.0 g/l, respectively, the electric resistance of the electrolyte increases and the current efficiency for tin plating becomes very low, and therefore, such low concentrations are not suitable for industrial production of the treated steel sheet by the present invention.

In an alkaline electrolyte:
Concentration of stannic ions: 30–70 g/l
Concentration of base (as NaOH or KOH): 10–25 g/l
Bath temperature: 70°–90° C.
Current density: 1–10 A/dm$^2$ Generally in an alkaline electrolyte as compared with an acid electrolyte, a more dense tin layer is obtained but the current efficiency for tin plating is lower. Especially, the current efficiency for tin plating decreases remarkably with an increase in current density and a decrease in bath temperature.

The ranges for the conditions as described above are suitable for the industrial production of the treated steel sheet by the present invention.

The amount of tin coating is 0.05–1.5 g/m$^2$, and with a light tin coating weight, such as 0.10 g/m$^2$, tin plated on the base steel changes sufficiently to the iron-tin alloy layer by heating at a somewhat higher temperature (about 250° C.) than the melting point of tin. However, for a heavy tin coating weight, such as 0.8 g/m$^2$, heating at a considerably higher temperature (300°–400° C.) than the melting point of tin is necessary. Generally, it is necessary that the temperature during formation of the iron-tin alloy be maintained in the range 232°–400° C. for 0.5–10 seconds.

The optimum range for the amount of iron-tin alloy is from 0.05 to 1.0 g/m$^2$, calculated as tin. The thickness of the iron-tin alloy layer is therefore about 0.0083–0.166 micron. If the amount of iron-tin alloy is below 0.05 g/m$^2$, the corrosion resistance becomes remarkably poor, for instance undercutting corrosion proceeds from scratches in the organic coating after immersion of the steel sheet in carbonated beverages for a few days. Especially, in this case, if the amount of chromium in the hydrated chromium oxide layer is also small, the undercutting corrosion is remarkable.

If the amount of iron-tin alloy is above 1.0 g/m$^2$, the corrosion of the base steel proceeds from cracks in the organic coating, caused by forming after organic coating, because the formability of the iron-tin alloy layer will be poor.

An increase in the amount of tin in the iron-tin alloy is equivalent to an increase in the thickness of the iron-tin alloy layer, namely, it increases the tin coating weight.

As described above, if the tin coating weight increases, higher temperatures and longer heating times will be necessary for sufficient formation of the iron-tin alloy from the tin plated on the base steel, and this is not economical.

It is assumed that a small amount of free tin, which should ideally be zero, remains in the iron-tin alloy layer. This free tin should be restricted to below one-third of the total tin coating weight in consideration of the characteristics of the present invention. An increase in the amount of free tin in the iron-tin alloy layer, to above this amount, leads to inferior bonding with organic adhesives and poor paint adhesion. Particularly when there is a small amount of chromium in the hydrated chromium oxide layer, bonding with organic adhesives and paint adhesion become remarkably poor after aging.

The hydrated chromium oxide layer is formed on the steel sheet, which has been covered by a thin iron-tin alloy layer, according to a cathodic treatment using a known electrolyte such as a sodium dichromate solution, which is used for conventional post-treatment of an electrolytic tinplate, or a chromic acid solution to which there is added a small amount of sulfuric acid, a fluorine compound, an aromatic disulfonic acid, thiourea or a combination thereof, as in the production of conventional TFS.

In the case of a cathodic treatment using a sodium dichromate solution, a quantity of electricity of about 4 to 20 times as much as that used for conventional post-treatment of an electrolytic tinplate (2–7 coulombs/dm$^2$) is necessary for the formation of the hydrated chromium oxide layer required in the present invention. The conditions for the electrolytic sodium dichromate treatment are preferably as follows:

Concentration of sodium dichromate: 20–60 g/l pH of bath (controlled by chromic acid and NaOH): 3.5–7.0

Bath temperature: 35°–70° C.

Current density: 8–40 A/dm$^2$

Treating time: 0.1–10 sec.

In the case of a cathodic treatment using a chromic acid solution to which is added a small amount of at least one additive selected from sulfuric acid, a fluorine compound (e.g. HF, NaF, KF, $NH_4F$, $H_2SiF_6$, $NaSiF_6$, $KSiF_6$, $NH_4SiF_6$, $HBF_4$, $NaBF_4$, $KBF_4$, $NH_4BF_4$, $NaHF_2$, $KHF_2$ and $NH_4HF_2$), an aromatic disulfonic acid (e.g. 2,4-disulfophenol, 3,5-disulfocatechol, 3,6-disulfonaphth-2-ol and 3,6-disulfo-1,8-dihydroxynaphthalene) and thiourea, a quantity of electricity of 50-150 coulombs/dm$^2$, which is used in the production of conventional TFS, is not suitable in the present invention, because of the formation of excess hydrated chromium oxide and the undesirable deposition of metallic chromium between the iron-tin alloy layer and the hydrated chromium oxide layer. Rather, in the present invention, the quantity of electricity should be limited to about 5–20 coulombs/dm$^2$. The conditions for the electrolytic chromic acid treatment are preferably as follows:

Concentration of chromic acid: 30–100 g/l

Weight ratio of chromic acid to additive, e.g. $H_2SO_4$ and a fluorine compound: 100–300

Bath temperature: 35°–70° C.

Current density: 5–50 A/dm$^2$

Treating time: 0.1–5 sec.

The optimum range for the amount of hydrated chromium oxide is 0.005–0.05 g/m$^2$, calculated as chromium. The thickness of the hydrated chromium oxide layer is about 0.007–0.07 micron. If the amount of hydrated chromium oxide is below 0.005 g/m$^2$, the hydrated chromium oxide layer can easily be peeled off from the iron-tin alloy layer after organic coating. It is assumed that this poor adhesion depends on a decrease in the inhibition effect of the hydrated chromium oxide layer towards oxidation of the iron-tin alloy layer, particularly after aging for a long time.

If the amount of hydrated chromium oxide is above 0.05 g/m$^2$, bonding with organic adhesives, paint adhesion and corrosion resistance after forming deteriorate because the formability of the hydrated chromium oxide layer will be poor.

According to the cathodic treatment using the above-mentioned chromic acid solution, metallic chromium, which is deposited between the hydrated chromium oxide layer and the iron-tin alloy layer in the form of a layer of metallic chromium having a maximum thickness of 0.0007 micron, does not dissolve into the foodstuff.

Too large an amount of deposited metallic chromium leads to poor formability and exhibits deleterious effects on the formability of the hydrated chromium oxide layer and organic coating. Therefore, the amount of metallic chromium must be below 0.005 g/m$^2$ in accordance with the present invention.

After the electrolytic treatment with sodium dichromate or chromic acid, dibutyl sebacate, dioctyl sebacate or cottonseed oil is usually coated on the treated steel sheet in the same way as in electrolytic tinning, for preventing scratches during handling.

The present invention is illustrated by the following Examples.

EXAMPLE 1

A cold reduced steel sheet having a thickness of 0.23 mm was electrolytically degreased in a solution of sodium hydroxide and then picked in dilute sulfuric acid. The steel sheet, after being rinsed with water, was electroplated with tin under the following plating conditions.

Composition of electrolyte:

Stannous sulfate: 30 g/l

Phenol sulfonic acid (60% aqueous solution): 25 g/l

Ethoxylated α-naphthol sulfonic acid: 3 g/l

Bath temperature: 45° C.
Cathodic current density: 7 A/dm$^2$
Total tin coating weight: 0.09 g/m$^2$
Tin weight in iron-tin alloy ($FeSn_2$): 0.07 g/m$^2$ After rinsing with water and drying, the tin-coated steel sheet was kept at a temperature of 232°–250° C. for 0.5 second by resistance heating, and then was immediately quenched. The steel sheet thus covered by an iron-tin alloy was cathodically treated under the following conditions and was then rinsed with water, dried and coated with a thin film of dioctyl sebacate (DOS) by the ordinary method used in the electrotinning process.

Composition of electrolyte:
Sodium dichromate: 30 g/l
Bath temperature: 50° C.
Cathodic current density: 10 A/dm$^2$
Chromium weight in hydrated chromium oxide: 0.015 g/m$^2$ The characteristics of the steel sheet thus coated mainly with an iron-tin alloy layer and a hydrated chromium oxide layer were evaluated by the following testing methods, the results of which are shown in the attached Table.

(1) Peel strength:

The treated sample was baked at 210° C. for 12 minutes after coating with 50 mg/dm$^2$ of phenol-epoxy type paint (Tradename SJ-6256 made by Kansai Paint Co., Ltd.).

Two pieces of the coated sample, which were each cut to a size of 8 mm × 150 mm, were bonded together by using a 100μ Nylon film (Tradename L 1801 made by Dainippon Co., Ltd.) at 200° C. for 30 seconds under 4 Kg/cm$^2$ of pressure after preheating at 200° C. for 60 seconds. The peel strength (Kg/8 mm) of the assembly was measured by a conventional tensile testing machine.

(2) Paint adhesion:

The sample coated and baked as described in (1) above was cut into a circular blank having a diameter of 80 mm by a punch press, and the blank was deeply drawn to form a cup at a drawing ratio of 2.0. The paint film on the bottom of the cup was cut crosswise with a razor, and an attempt was made to peel the paint film from the side and bottom of the cup with an adhesion tape.

(3) Corrosion resistance against an acidic solution after forming:

The sample coated and baked as described in (1) above was cut to a size of 15 mm × 100 mm. The test piece was prebent to form a $\bigvee$ -shaped article, and was then further bent to 180° by the drop of a 3 Kg weight from a height of 150 mm after placing a steel sheet having a thickness of 0.28 mm between the two sides of the prebent test piece. The bent test piece was sealed in an adhesion tape made of a polyvinyl chloride film, except for the formed part of the bent test piece, and was then immersed in 300 ml of a 0.01 mole/l phosphoric acid solution at room temperature for one week. The same procedure was repeated for another test piece, except using a 0.01 mole/l citric acid solution containing 0.3% by weight of sodium chloride. Iron pick-up in each solution was measured and the change in the surface appearance of each test piece was evaluated with the naked eye.

(4) Sulfide staining:

A cup as used for the paint adhesion test was immersed in a 10 g/l sodium sulfide solution maintained at pH 3.5 by lactic acid, at 90° C. for 1 hour. The proportion of discoloration through the paint film on the deeply drawn portion of the cup was evaluated with the naked eye.

EXAMPLE 2

A steel sheet pretreated as in Example 1 was plated with tin under the following plating conditions, after which the tin-coated steel sheet was maintained at 232°–260° C. for 3.0 seconds by resistance heating and then was immediately quenched. The steel sheet thus covered with an iron-tin alloy was subjected to an electrolytic chromic acid treatment under the following conditions, after which DOS was coated thereon in the same manner as mentioned in Example 1.

Conditions of Electrotinplating

Composition of electrolyte:
Stannous sulfate: 5 g/l
Phenol sulfonic acid (60% aqueous solution): 4 g/l
Ethoxylated α-naphthol sulfonic acid: 0.5 g/l
Bath temperature: 45° C.
Cathodic current density: 10 A/dm$^2$
Total tin coating weight: 0.30 g/m$^2$
Tin weight in iron-tin alloy ($FeSn_2$): 0.21 g/m$^2$

Conditions of Electrolytic Chromic Acid Treatment

Composition of electrolyte:
Chromic acid: 80 g/l
Sulfuric acid: 0.4 g/l
Fluoboric acid: 0.3 g/l
Bath temperature: 50° C.
Cathodic current density: 15 A/dm$^2$
Metallic chromium weight: 0.003 g/dm$^2$
Chromium weight in hydrated chromium oxide: 0.043 g/dm$^2$ The characteristics of the thus treated steel sheet were evaluated by the test methods described in Example 1, the results of which are shown in the Table.

EXAMPLE 3

A steel sheet pretreated as in Example 1 was plated with tin under the following plating conditions, after which the steel sheet was maintained at 232°–260° C. for 2.0 seconds by means of resistance heating, to obtain a steel sheet coated with an iron-tin alloy. The coated steel sheet was subjected to a cathodic treatment in 30 g/l of sodium dichromate under 5 A/dm$^2$ at a bath temperature of 50° C.

The characteristics of the steel sheet, having 0.007 g/m$^2$ as chromium in the thus formed hydrated chromium oxide layer, were evaluated by the test methods described in Example 1. The results are shown in the Table.

Conditions of Electrotinplating

Composition of electrolyte:
Sodium stannate: 80 g/l
Sodium hydroxide: 15 g/l
Bath temperature: 80° C.
Cathodic current density: 2 A/dm$^2$
Total tin coating weight: 0.22 g/m$^2$
Tin weight in iron-tin alloy ($FeSn_2$): 0.20 g/m$^2$

EXAMPLE 4

A steel sheet pretreated as in Example 1 was plated with tin under the following plating conditions, after which the steel sheet was maintained at 232°–330° C. for 4.0 seconds by resistance heating, to obtain a steel sheet coated with an iron-tin alloy. The coated steel sheet was subjected to electrolytic chromic acid treatment under the following conditions, and DOS was coated on the thus treated steel sheet in the same manner as mentioned in Example 1.

Conditions of Electrotinplating

Composition of electrolyte:
Sodium stannate: 80 g/l
Sodium hydroxide: 15 g/l
Bath temperature: 80° C.
Cathodic current density: 3 A/dm$^2$
Total tin coating weight: 0.85 g/m$^2$
Tin weight in iron-tin alloy ($FeSn_2$): 0.69 g/m$^2$ Conditions of Electrolytic Chromic Acid Treatment Composition of electrolyte:
Chromic acid: 60 g/l
Sulfuric acid: 0.3 g/l
Bath temperature: 55° C.
Cathodic current density: 20 A/dm$^2$
Metallic chromium weight: 0.004 g/m$^2$
Chromium weight in hydrated chromium oxide: 0.021 g/m$^2$ The characteristics of the thus treated steel sheet were evaluated by the test methods described in Example 1, and the results are shown in the Table.

Comparative Example 1

A steel sheet pretreated as in Example 1 was plated with tin under the following plating conditions, after which the tin-coated steel sheet was flow-melted by using ordinary resistance heating as in the electrotinning process, and then was subjected to cathodic treatment in 30 g/l of sodium dichromate under 3 A/dm$^2$ at a bath temperature of 50° C.

The characteristics of the resultant electrotinplate, having 0.004 g/m$^2$ as chromium in the hydrated chromium oxide layer, were evaluated by the test methods described in Example 1. The results are shown in the Table.

Conditions of Electrotinplating

Composition of electrolyte:
Stannous sulfate: 60 g/l
Phenol sulfonic acid (60% aqueous solution): 50 g/l
Ethoxylated α-naphthol sulfonic acid: 6 g/l
Bath temperature: 45° C.
Cathodic current density: 8 A/dm$^2$
Total tin coating weight: 5.58 g/m$^2$
Tin weight in iron-tin alloy ($FeSn_2$): 0.49 g/m$^2$ Comparative Example 2

A steel sheet pretreated as in Example 1 was subjected to electrolytic chromic acid treatment under the following conditions. After rinsing with water and drying, DOS was coated thereon by the same method as described in Example 1.

Conditions of Electrolytic Chromic Acid Treatment

Composition of electrolyte:
Chromic acid: 80 g/l
Sulfuric acid: 0.4 g/l
Fluoboric acid: 0.2 g/l
Bath temperature: 55° C.
Cathodic current density: 40 A/dm$^2$
Metallic chromium weight: 0.11 g/m$^2$
Chromium weight in hydrated chromium oxide: 0.023 g/m$^2$ The characteristics of the resultant TFS were evaluated by the test methods described in Example 1, the results of which are shown in the Table.

As apparent from the Table, the treated steel sheet of the present invention has excellent peel strength, paint adhesion after forming, corrosion resistance to acids after forming, and sulfide stain resistance, and this treated steel sheet is therefore very suitable for use as a material for making food cans, a field in which electrotinplate and TFS are widely used.

Table

| Characteristics of Treated Steel Sheets | | | | | | | | |
|---|---|---|---|---|---|---|---|---|
| | | | Example 1 | Example 2 | Example 3 | Example 4 | Comparative Example 1 (tinplate) | Comparative Example 2 (TFS) |
| Tinplating | Tinplating bath | | Phenol sulfonic acid bath | Phenol sulfonic acid bath | $Na_2SnO_3$ bath | $Na_2SnO_3$ bath | Phenol sulfonic acid bath | — |
| | Total tin coating weight in g/m$^2$ | | 0.09 | 0.30 | 0.22 | 0.85 | 5.58 | — |
| | Amount of $FeSn_2$ (as Sn) in g/m$^2$ | | 0.07 | 0.21 | 0.20 | 0.69 | 0.49 | — |
| Electrolytic chromic acid treatment | Amount of hydrated Cr oxide (as Cr) in g/m$^2$ | | 0.015 | 0.043 | 0.007 | 0.021 | 0.004 | 0.023 |
| | Amount of metallic Cr in g/m$^2$ | | 0 | 0.003 | 0 | 0.004 | 0 | 0.11 |
| Peel strength in Kg/8 mm | | | 7.9 | 6.8 | 8.7 | 7.0 | 1.0 | 8.2 |
| Paint adhesion | | | No adhesion loss on bottom or side of drawn cup | No adhesion loss on bottom or side of drawn cup | No adhesion loss on bottom or side of drawn cup | No adhesion loss on bottom or side of drawn cup | Paint is peeled off on bottom; no adhesion loss on side of drawn cup | No adhesion loss on bottom or side of drawn cup |
| Corrosion resistance after forming | 0.01 mole/l $H_3PO_4$ | Appearance | Slight surface corrosion | Slight surface corrosion | Slight surface corrosion | Slight surface corrosion | Slight surface corrosion | Substantial pitting |
| | | Dissolved Fe in ppm | 0.32 | 0.24 | 0.26 | 0.13 | 0.20 | 0.83 |
| | 0.01 mole/l citric acid | Appearance | Slight pitting | Slight pitting | Slight pitting | Slight pitting | Slight pitting | Substantial pitting |
| | | Dissolved Fe in ppm | 0.43 | 0.34 | 0.21 | 0.15 | 0.31 | 1.06 |
| Sulfide staining | | | No blackening | No blackening | Slight blackening | Slight blackening | More than slight blackening | No blackening |
| Total evaluation | | | Good | Good | Good | Good | Poor | Fair |

We claim:

1. A process for producing a steel sheet containing a first layer of an iron-tin alloy and a second layer of hydrated chromium oxide which comprises electrolytically tin plating a substantially clean steel sheet base in an electrolyte containing stannous sulfate, stannous chloride, stannous fluoborate, sodium stannate or potassium stannate, to obtain a tin-plated steel sheet in which the amount of plated tin is 0.05–1.5 g/m$^2$, heating said tin-plated steel sheet at a temperature sufficiently above the melting point of tin for a time sufficient to form a first layer containing an iron-tin alloy on the surface of said base, the amount of said iron-tin alloy being 0.05–1.0 g/m$^2$, calculated as tin, the amount of any free tin in said first layer being less than one-third of the total amount of said plated tin, and subjecting the resultant steel sheet to an electrolytic treatment at 5–20 coulombs/dm$^2$ in an electrolyte containing chromic acid and at least one additive selected from the group consisting of sulfuric acid, a fluorine compound, an aromatic disulfonic acid and thiourea, to form a second layer consisting essentially of hydrated chromium oxide in an amount of 0.005–0.05 g/m$^2$, calculated as chromium, any metallic chromium deposited between said first and second layers being present in an amount less than 0.005 g/m$^2$.

2. A process according to claim 1, wherein electrolytic tin plating is carried out in an acidic electrolyte at a temperature of 30°–60° C and a current density of 5–50 A/dm$^2$, the concentration of stannous ions in the electrolyte being 1.5–20 g/l, the concentration of acid in the electrolyte being 1.0–15 g/l, the weight ratio of said stannous ions to said acid being 1–3:1.

3. A process according to claim 1, wherein electrolytic tin plating is carried out in an alkaline electrolyte at a temperature of 70°–90° C and a current density of 1–10 A/dm$^2$, the concentration of stannic ions in the electrolyte being 30–70 g/l, the concentration of base in the electrolyte being 10–25 g/l.

4. A process according to claim 1, wherein heating said tin-plated steel sheet is carried out at a temperature of 232°–400° C for 0.5–10 seconds.

5. A process according to claim 1, wherein electrolytic treatment to form said second layer is carried out at a temperature of 35°–70° C and a current density of 5–50 A/dm$^2$ for 0.1–5 seconds in an electrolyte containing 30–100 g/l of chromic acid, the weight ratio of said chromic acid to said additive being 100–300:1.

6. A process according to claim 1, wherein said fluorine compound is selected from the group consisting of HF, NaF, KF, $NH_4F$, $H_2SiF_6$, $NaSiF_6$, $KSiF_6$, $NH_4SiF_6$, $HBF_4$, $NaBF_4$, $KBF_4$, $NH_4BF_4$, $NaHF_2$, $KHF_2$ and $NH_4HF_2$ and said aromatic disulfonic acid is selected from the group consisting of 2,4-disulfophenol, 3,5-disulfocatechol, 3,6-disulfonaphth-2-ol and 3,6-disulfo-1,8-dihydroxynaphthalene.

7. A process for producing a steel sheet containing a first layer of an iron-tin alloy and a second layer of hydrated chromium oxide which comprises electrolytically tin plating a substantially clean steel sheet base in an electrolyte containing stannous sulfate, stannous chloride, stannous fluoborate, sodium stannate or potassium stannate, to obtain a tin-plated steel sheet in which the amount of plated tin is 0.05–1.5 g/m$^2$, heating said tin-plated steel at a temperature sufficiently above the melting point of tin for a time sufficient to form a first layer containing an iron-tin alloy on the surface of said base, the amount of said iron-tin alloy being 0.05–1.0 g/m$^2$, calculated as tin, the amount of any free tin in said first layer being less than one-third of the total amount of said plated tin, and subjecting the resultant steel sheet to an electrolytic treatment at 8–140 coulombs/dm$^2$ in an electrolyte containing sodium dichromate, to form a second layer consisting essentially of hydrated chromium oxide in an amount of 0.005–0.05 g/m$^2$, calculated as chromium any metallic chromium deposited between said first and second layers being present in an amount less than 0.005 g/m$^2$.

8. A process according to claim 7, wherein electrolytic tin plating is carried out in an acidic electrolyte at a temperature of 30°–60° C and a current density of 5–50 A/dm$^2$, the concentration of stannous ions in the electrolyte being 1.5–20 g/l, the concentration of acid in the electrolyte being 1.0–15 g/l, the weight ratio of said stannous ions to said acid being 1–3:1.

9. A process according to claim 7, wherein electrolytic tin plating is carried out in an alkaline electrolyte at a temperature of 70°–90° C and a current density of 1–10 A/dm$^2$, the concentration of stannic ions in the electrolyte being 30–70 g/l, the concentration of base in the electrolyte being 10–25 g/l.

10. A process according to claim 7, wherein heating said tin-plated steel sheet is carried out at a temperature of 232°–400° C for 0.5–10 seconds.

11. A process according to claim 7, wherein electrolytic treatment to form said second layer is carried out at a temperature of 35°–70° C and a current density of 8–40 A/dm$^2$ for 0.1–10 seconds in an electrolyte having a pH of 3.5–7.0 containing 20–60 g/l of sodium dichromate.

* * * * *